US005548868A

United States Patent [19]

Berfield et al.

[11] Patent Number: 5,548,868

[45] Date of Patent: Aug. 27, 1996

[54] PILOT AND DETENT APPARATUS FOR A VACUUM DEVICE

[75] Inventors: Robert C. Berfield, Jersey Shore; Alan D. Kaufman, South Williamsport, both of Pa.

[73] Assignee: Shop Vac Corporation, Williamsport, Pa.

[21] Appl. No.: 502,273

[22] Filed: Jul. 13, 1995

[51] Int. Cl.[6] ..... A47L 5/36

[52] U.S. Cl. ..... 15/339; 15/327.2; 15/327.6

[58] Field of Search ..... 15/327.1, 327.2, 15/327.6, 353, 339

[56] References Cited

U.S. PATENT DOCUMENTS

| | | | |
|---|---|---|---|
| 4,185,974 | 1/1980 | Hiester | 15/327.6 X |
| 4,435,877 | 3/1984 | Berfield | 15/326 |
| 4,538,971 | 9/1985 | Miller et al. | 15/327.2 X |
| 4,655,694 | 4/1987 | Berfield | 15/327.2 X |
| 4,797,072 | 1/1989 | Berfield et al. | 15/353 X |
| 5,353,470 | 10/1994 | Bartlett | 15/327.6 X |
| 5,404,614 | 4/1995 | Stephens | 15/327.6 X |

*Primary Examiner*—Chris K. Moore

*Attorney, Agent, or Firm*—Marshall, O'Toole, Gerstein, Murray & Borun

[57] ABSTRACT

A vacuum apparatus includes a holding tank for holding debris picked up by the vacuum apparatus, a lid cage for holding a filter between a vacuum inlet and a vacuum outlet of the vacuum device, a motor housing for housing a motor subassembly as a source of vacuum, attaching means for attaching one of the lid cage and the motor housing to the holding tank, and a detent cooperating with the motor housing and the lid cage for providing an indication to an assembler that the lid cage and the motor housing have been properly seated with respect to one another. A pilot is provided for guiding relative movement between the lid cage and the motor housing in order to facilitate the indication provided by the detent that the lid cage and the motor have been properly seated.

30 Claims, 8 Drawing Sheets

PILOT AND DETENT APPARATUS FOR A VACUUM DEVICE

FIELD OF THE INVENTION

The present invention relates to an apparatus for facilitating the assembly of a vacuum device.

BACKGROUND OF THE INVENTION

A vacuum device, such as a wet/dry vacuum cleaner, may include, for example, a motor housing, a lid cage, and a tank. The motor housing houses a motor which drives an impeller to create a vacuum for the vacuum device. The lid cage includes a filter cage that holds a filter which filters the air moving through the vacuum device in response to the vacuum created by the impeller.

During assembly of the vacuum device, the motor and impeller are inserted into the motor housing, and the motor housing is attached to the lid cage so that the motor and impeller are clamped therebetween. The lid cage has clamps for clamping the motor housing and lid cage to the tank of the vacuum device.

The motor housing is normally attached to the lid cage by way of screws, bolts, or other fasteners that are fitted through corresponding holes in the motor housing and the lid cage. For ease of assembly, it is important that the motor housing and the lid cage properly seat together so that the corresponding holes in the motor housing and in the lid cage properly align. If these holes properly align, the fasteners may be easily applied in order to secure the motor housing and the lid cage to one another. The present invention is directed to an apparatus which facilitates proper seating between the motor housing and the lid cage of a vacuum device so that the motor housing and the lid cage may be properly and easily secured to one another.

SUMMARY OF THE INVENTION

In accordance with one aspect of the present invention, a vacuum apparatus comprises a holding tank for holding debris picked up by the vacuum apparatus, a lid cage for holding a filter, a motor housing for housing a motor as a source of vacuum, attaching means for attaching the lid cage and the motor housing to the holding tank, and a detent cooperating with the motor housing and the lid cage for providing an indication to an assembler that the lid cage and the motor have been properly seated with respect to one another.

In accordance with another aspect of the present invention, a vacuum apparatus comprises a holding tank for holding debris picked up by the vacuum apparatus, a lid cage for holding a filter wherein the lid cage has an attaching mechanism for attaching the lid cage to the holding tank, a motor housing attachable to the lid cage, a detent cooperating with the motor housing and the lid cage for providing an indication to an assembler that the lid cage and the motor have been properly seated with respect to one another, and a pilot for guiding relative movement between the lid cage and the motor housing in order to facilitate the indication provided by the detent that the lid cage and the motor have been properly seated.

In accordance with yet another aspect of the present invention, a subassembly for a vacuum apparatus comprises a lid cage for holding a filter, a motor housing attachable to the lid cage, and a detent cooperating with the motor housing and the lid cage for providing an indication to an assembler that the lid cage and the motor housing have been properly seated with respect to one another.

BRIEF DESCRIPTION OF THE DRAWINGS

These and other features and advantages will become more apparent from a detailed consideration of the invention when taken in conjunction with the drawings in which.

DETAILED DESCRIPTION OF THE INVENTION

Figure 1:
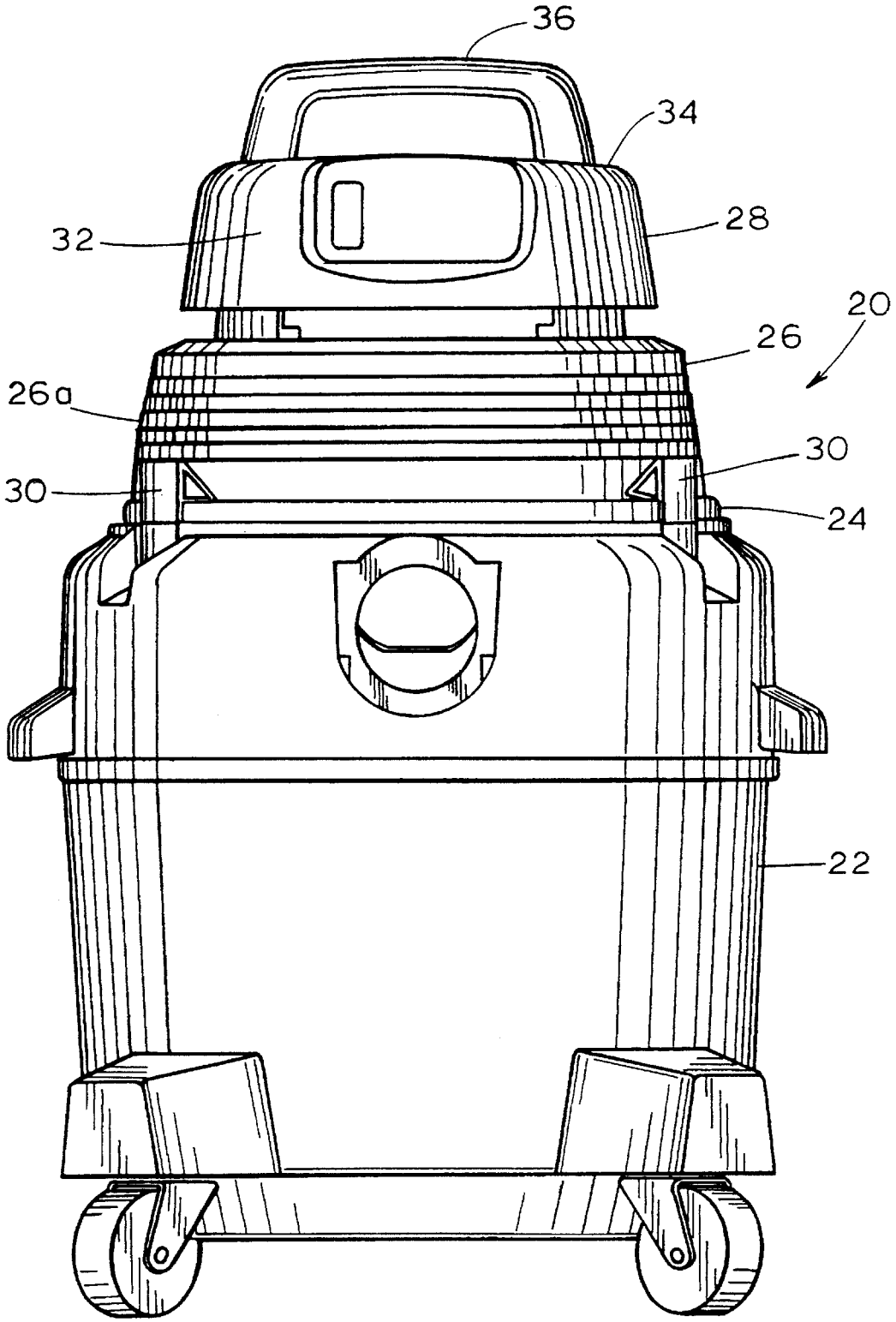
FIG. 1 is an elevational side view of a vacuum device incorporating the present invention.
Figure 2:
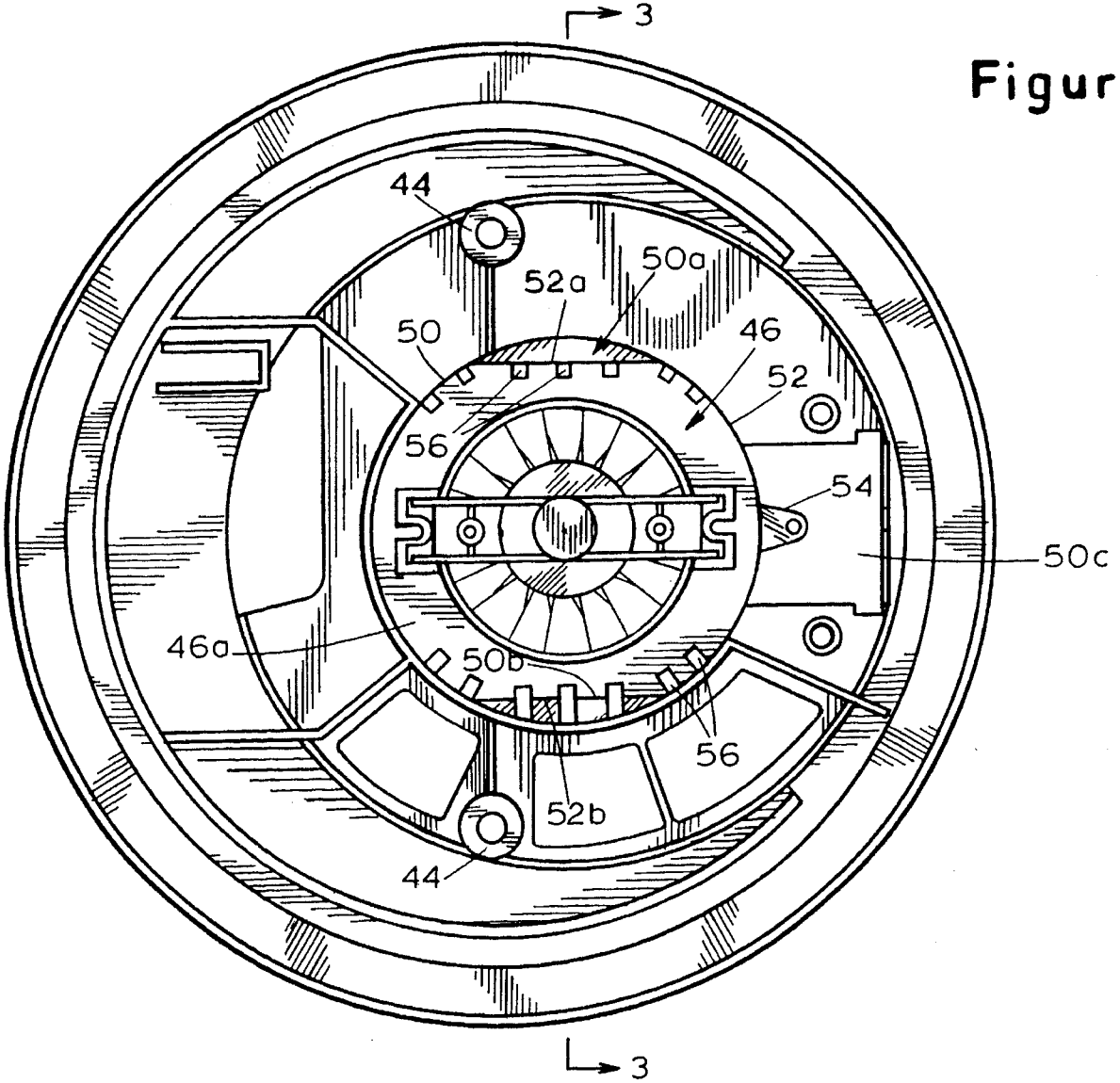
FIG. 2 is an elevational top view of the motor housing and motor of the vacuum device of FIG. 1 with the cover of the vacuum device removed.
Figure 3:
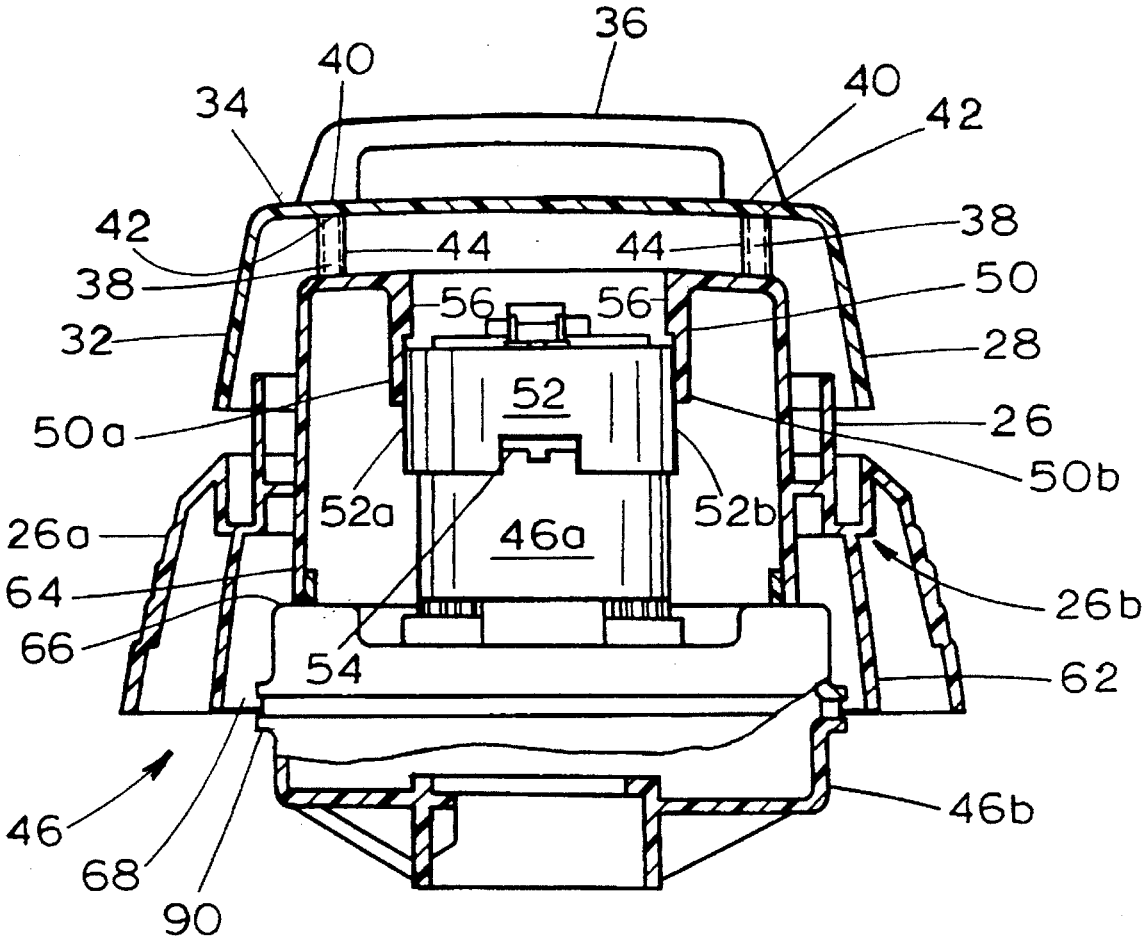
FIG. 3 is a partial sectional view, taken generally along the lines 3—3, of FIG. 2.

As shown in FIGS. 1–3, a vacuum device 20, such as a wet/dry vacuum cleaner, includes a tank 22, a lid cage 24, a motor housing 26 having a side wall 26*a* and an internal surface 26*b*, and a cover 28. The vacuum device may have a vacuum inlet for admitting air into the vacuum device 20 and a vacuum outlet for expelling air from the vacuum device 20. The tank 22, the lid cage 24, the motor housing 26, and the cover 28 may each be formed of a suitable material such as molded plastic. The lid cage has a plurality of clamps 30 in order to secure the lid cage 24, the motor housing 26, and the cover 28 to the tank 22. The cover 28 has a side wall 32 and a top surface 34 to which a handle 36 is affixed by a pair of screws 38. The screws 38 extend through a pair of clearance apertures 40 at opposite ends of the handle 36 and a pair of clearance apertures 42 in the top surface 34 of the cover 28. The screws 38 are threadably received in a pair of upwardly facing bores 44 formed integrally with the motor housing 26. Accordingly, the motor housing 26 supports the cover 28.

Figure 9:
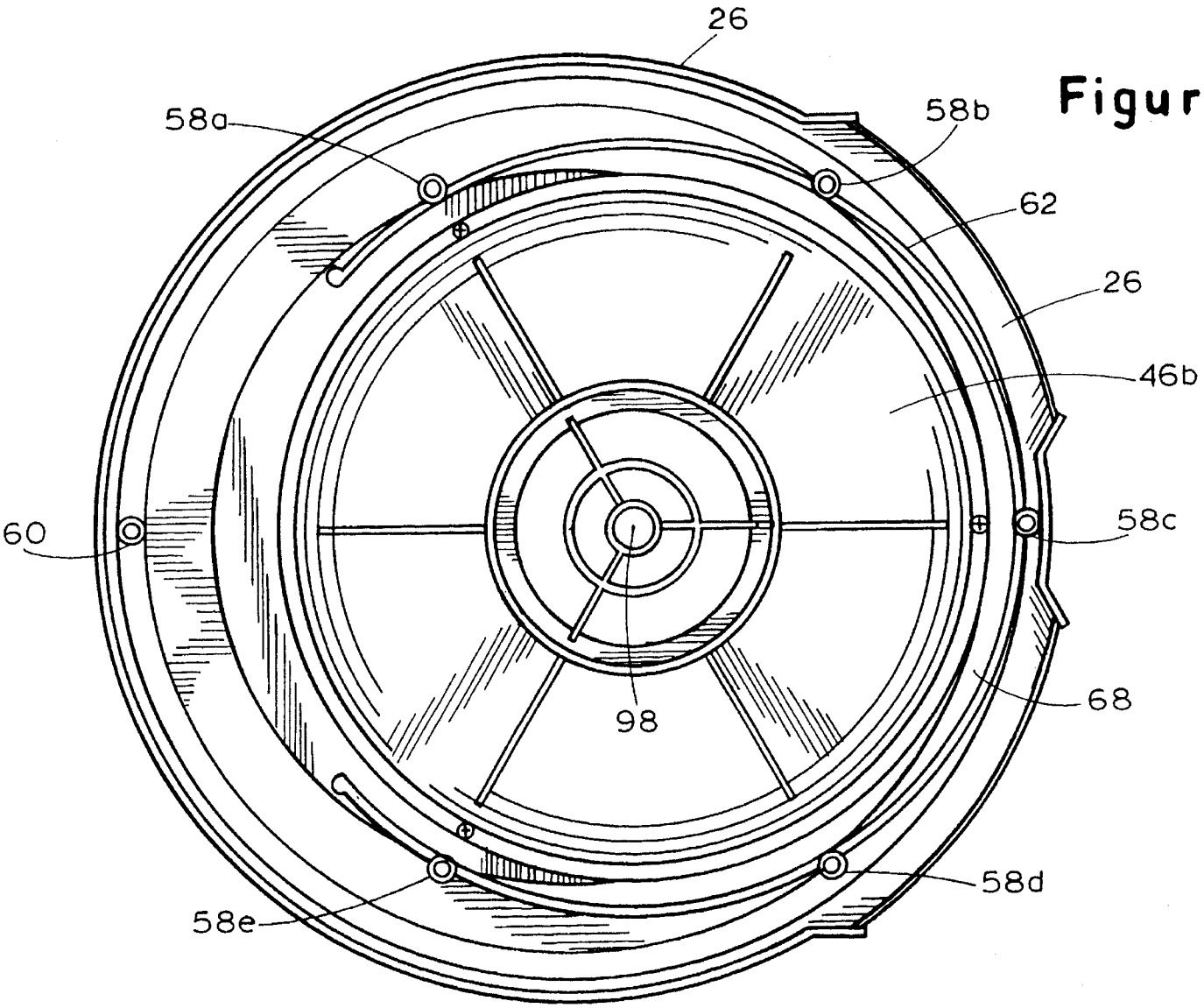

As shown in FIGS. 2, 3, and 9, disposed within the motor housing 26 is a motor subassembly 46 having an electric motor 46*a* and an impeller which is within an impeller cover 46*b* and which is drivingly connected to the electric motor 46*a* in order to create a vacuum for the vacuum device 20. For clarity, the motor subassembly 46 is not fully shown in section in the drawings.

Figure 8:
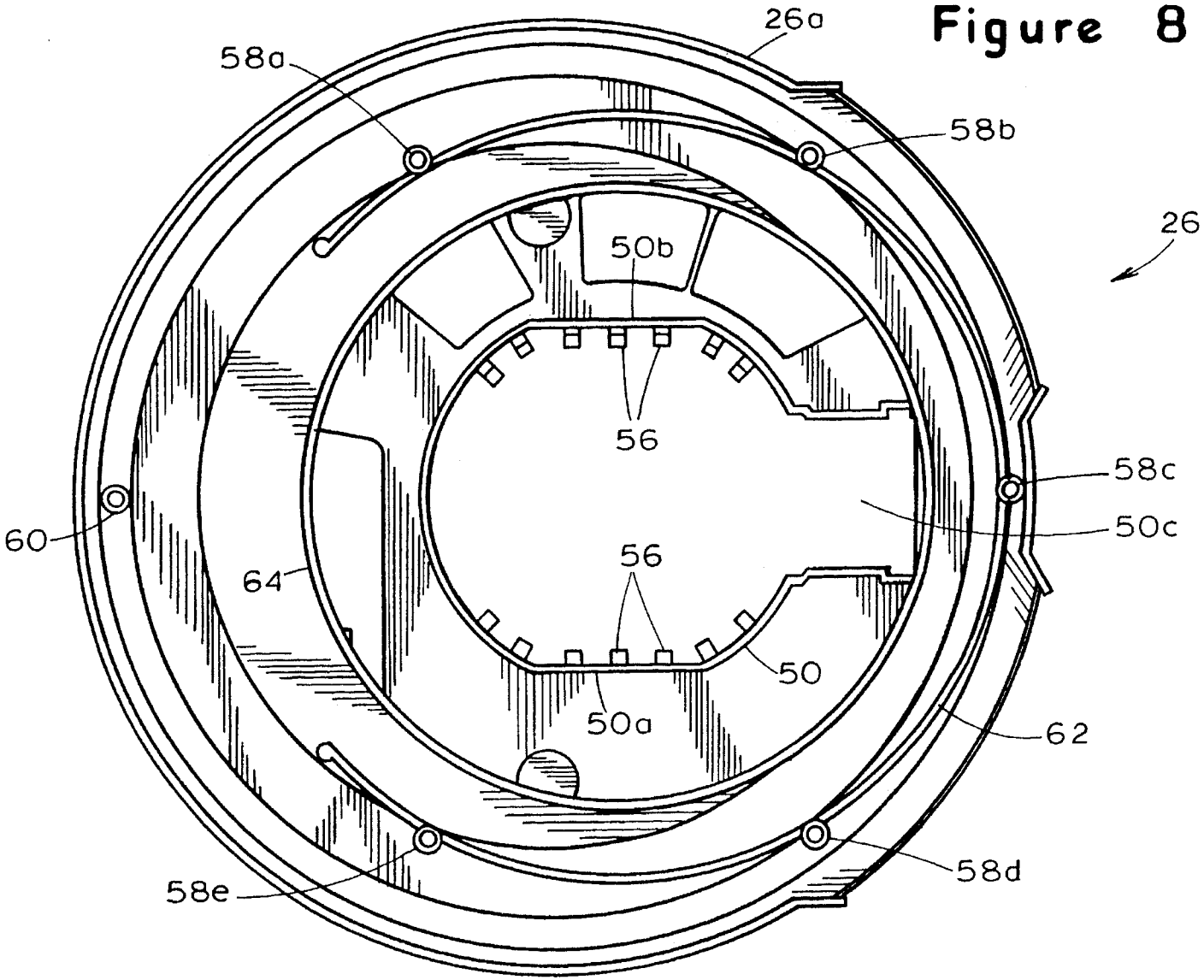
FIG. 8 is an elevational bottom view of the motor housing shown in FIG. 1; and, FIG. 9 is an elevational bottom view of the motor and impeller in the motor housing shown in FIG. 8.

As shown in FIGS. 2, 3, and 8, the motor housing 26 has a first neck 50 for receiving a vertical surface 52 of the electric motor 46*a*. The first neck 50 has a pair of opposing flat regions 50*a* and 50*b* which mate with corresponding flat regions 52*a* and 52*b* of the vertical surface 52 of the electric motor 46*a*. The first neck 50 also has a slot 50*c* for receiving a terminal 54 of the electric motor 46*a*, and a plurality of ribs 56 which act to limit movement of the motor subassembly 46 when the motor subassembly 46 is contained between the motor housing 26 and the lid cage 24. The slot 50*c* and the opposing flat regions 50*a* and 50*b* allow the motor subassembly 46 to be inserted into the motor housing 26 in a preferred orientation.

As further shown in FIGS. 3 and 8, the motor housing 26 has a plurality of internally threadable bosses 58*a*–58*e* and 60. The internally threadable bosses 58*a*–58*e* are at least partially supported by a pilot guide wall 62. As will be discussed below more fully, at least some of the internally threadable bosses 58*a*–58*e* and 60 are arranged to align with corresponding holes in the lid cage 24 which has the clamps 30 and which is positioned between the tank 22 and the motor housing 26. The motor housing 26 has a second neck 64 which acts as a clamping surface for clamping the motor subassembly 46 to the lid cage 24. Accordingly, the second neck 64 of the motor housing 26 engages a circular surface 66 of the impeller cover 46*b* of the motor subassembly 46.

FIG. 9 shows the motor subassembly 46 and the motor housing 26 after the motor subassembly 46 has been inserted into the motor housing 26. When assembled, a pilot guide slot 68 is formed between motor subassembly 46 (particularly the impeller cover 46*b*) and the pilot guide wall 62 (also see FIG. 3). As shown in FIG. 9, the pilot guide slot 68 is curved. More specifically, the pilot guide slot 68 is semi-circular.

Figure 4:
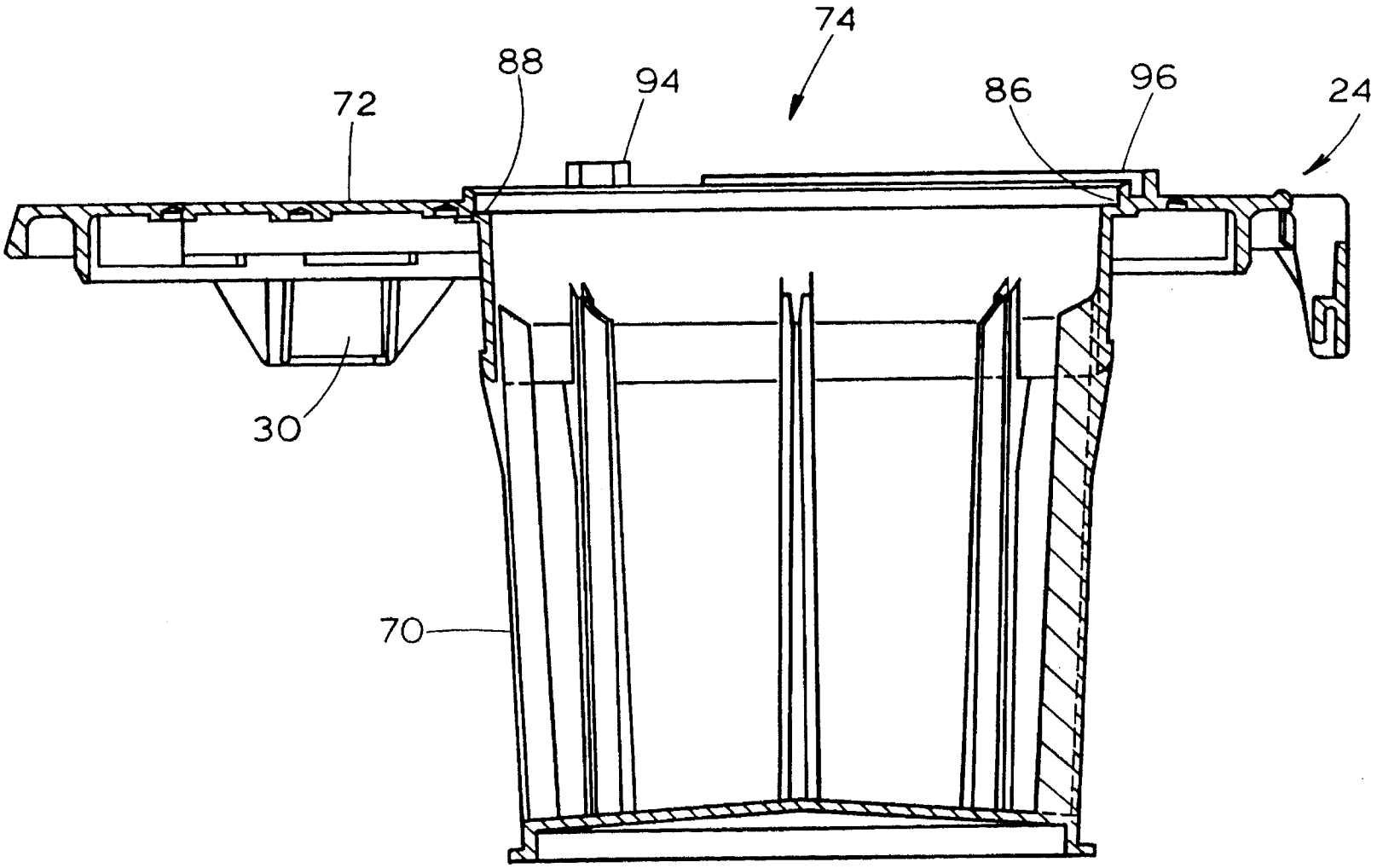
FIG. 4 is an sectional side view of a lid cage configured in accordance with the present invention.
Figure 5:
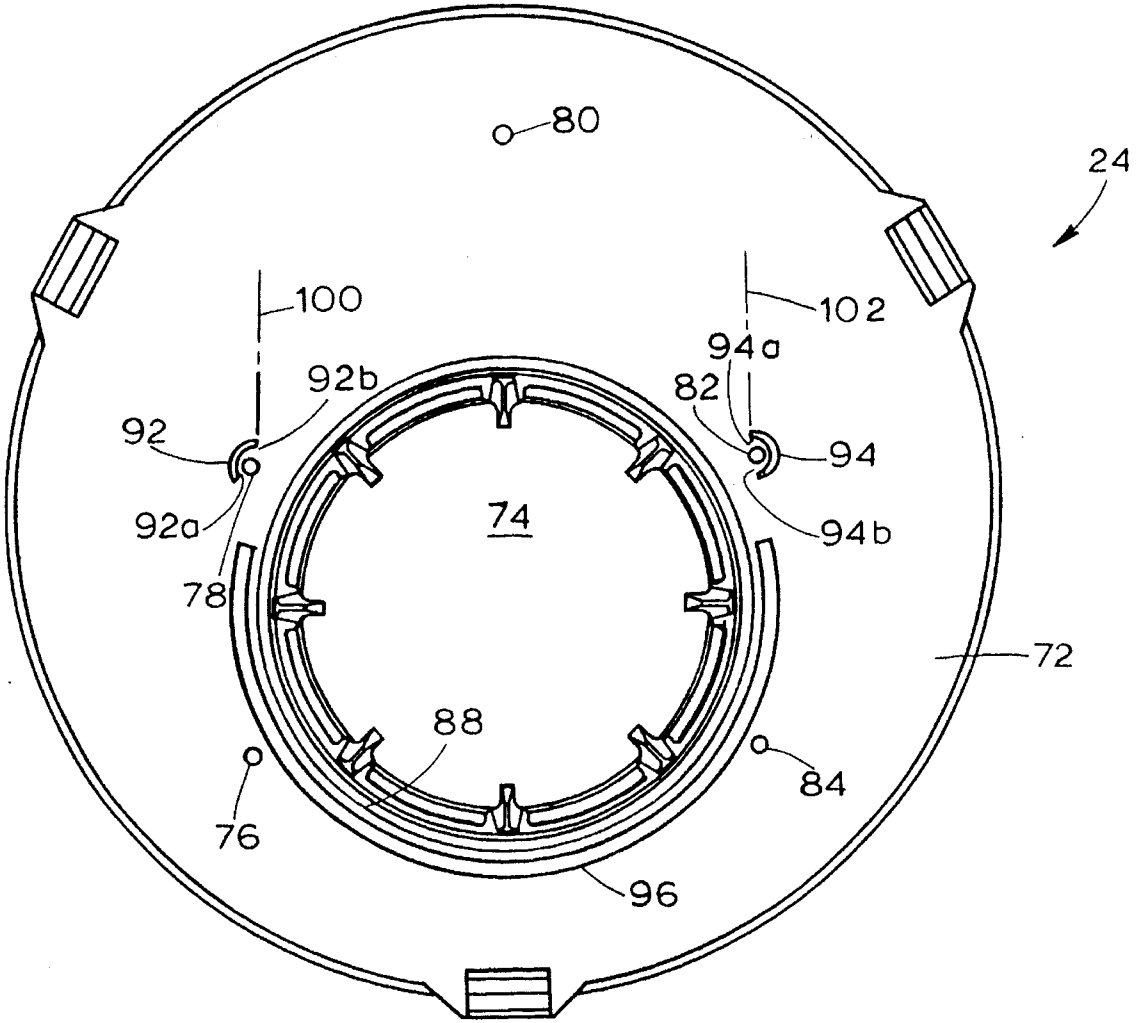
FIG. 5 is an elevational top view of the lid cage configured in accordance with the present invention.

The lid cage 24, as shown in FIGS. 4 and 5, has a filter cage 70 which holds a filter of the vacuum device 20. The lid cage 24 also has a bearing surface 72 which supports the motor subassembly 46 and the motor housing 26. An opening 74 through the bearing surface 72 permits a filter to be inserted into the filter cage 70. The bearing surface 72 also has a plurality of holes 76, 78, 80, 82, and 84 which, when the motor housing 26 seats properly upon the lid cage 24, are aligned for receiving fasteners in order to affix the motor housing 26 and the lid cage 24 together.

A recess 86 in the bearing surface 72 forms a bearing ledge 88 which engages a lower surface 90 (FIG. 3) of the impeller cover 46*b* of the motor subassembly 46 when the motor housing 26 and the motor subassembly 46 are seated on the lid cage 24. Consequently, the bearing ledge 88 of the bearing surface 72 of the lid cage 24 supports the motor subassembly 46 when the motor subassembly 46 and the motor housing 26 are properly brought into contact with the bearing surface 72 of the lid cage 24. When the motor subassembly 46 and the motor housing 26 are brought into contact with the bearing surface 72 of the lid cage 24, the lower part of the impeller cover 46*b* protrudes into the filter cage 70.

As shown in FIG. 5, the bearing surface 72 of the lid cage 24 has a pair of detents 92 and 94 which project upwardly therefrom and which cooperate with the internally threadable bosses 58*a* and 58*e*, respectively, of the motor housing 26. The bearing surface 72 also has a pilot 96. As shown in FIGS. 4 and 5, the pilot 96 is a curved projection. More specifically, the pilot 96 is a semi-circular projection extending upwardly from the bearing surface 72.

During assembly of the vacuum device 20, (a) the assembler attaches the handle 36 and the cover 28 to the motor housing 26 by use of the screws 38, (b) the assembler inserts the assembled handle 36, cover 28, and motor housing 26 into a clamping fixture for holding these parts during further assembly, (c) the assembler inserts the motor subassembly 46 into the motor housing 26, and (d) the assembler applies the bearing surface 72 to the motor subassembly 46 and the motor housing 26 (i) so that the internal surface 26*b* of the motor housing 26 faces the bearing surface 72, (ii) so that the pilot 96 enters the pilot guide slot 68 formed between the impeller cover 46*b* and the pilot guide wall 62, (iii) so that, when the pilot 96 is fully inserted into the pilot guide slot 68, the side wall 26*a*, the internally threadable bosses 58*a*–58*e*, and the pilot guide wall 62 contact the bearing surface 72, and (iv) so that, as the lid cage 24 is viewed in FIG. 5, the internally threadable boss 58*a* is just below the detent 92 and the internally threadable boss 58*e* is just above the detent 94.

The assembler then rotates the lid cage 24 with respect to the motor subassembly 46 and the motor housing 26. As the lid cage 24 rotates with respect to the motor subassembly 46 and the motor housing 26, the pilot 96 guides this rotation and maintains the relative positions between the motor housing 26 and the lid cage 24. When the lid cage 24 has been rotated sufficiently with respect to the motor subassembly 46 and the motor housing 26, the internally threadable boss 58*a* engages a rounded corner 92*a* of the detent 92, and the internally threadable boss 58*e* engages a rounded corner 94*a* of the detent 94. Accordingly, the detents 92 and 94 offer a small resistance to the rotation of the motor cover 26 with respect to the lid cage 24.

Upon further rotation of the lid cage 24 with respect to the motor subassembly 46 and the motor housing 26, this small resistance is overcome, the internally threadable boss 58*a* snaps into a rounded recess 92*b* of the detent 92 and comes to rest against an inner radius of the detent 92, and the internally threadable boss 58*e* snaps into a rounded recess 94*b* of the detent 94 and comes to rest against an inner radius of the detent 94. This detent action, i.e., the initial resistance to rotation and then the snapping of the internally threadable bosses 58*a* and 58*e* into their corresponding detents 92 and 94, indicates to the assembler that the internally threadable bosses 58*a*–58*e* of the motor housing 26 and the holes 76–84 of the lid cage 24 are properly aligned to receive fasteners. This alignment is also aided by the pilot 96 interacting with the pilot guide slot 68. Preferably, although not essentially, only the outer surface of the pilot 96 interacts with the pilot guide slot 68.

When rotation ceases because the internally threadable boss 58*a* fully engages the inner radius of the detent 92 and the internally threadable boss 58*e* fully engages the inner radius of the detent 94, the internally threadable boss 58*b* of the motor housing 26 aligns with the hole 76 of the lid cage 24, the internally threadable boss 58*a* of the motor housing 26 aligns with the hole 78 of the lid cage 24, the internally threadable boss 60 of the motor housing 26 aligns with the hole 80 of the lid cage 24, the internally threadable boss 58*e* of the motor housing 26 aligns with the hole 82 of the lid cage 24, and the internally threadable boss 58*d* of the motor housing 26 aligns with the hole 84 of the lid cage 24. Fasteners, such as threaded screws, may then be inserted through the holes 76, 78, 80, 82, and 84 and turned into the corresponding internally threadable bosses 58*b*, 58*a*, 60, 58*e*, and 58*d*. As the threaded screws are turned, they cut threads into the internally threadable bosses 58*b*, 58*a*, 60, 58*e*, and 58*d* and are held therein. The motor housing 26 and the lid cage 24 are then set on the tank 22 with the filter cage 74 protruding therein, and the clamps 30 are used to clamp the motor housing 26 and the lid cage 24 to the tank 22.

Furthermore, the pilot 96 acts as a noise seal between the interior of the motor housing 26 and the exterior of the vacuum device 20.

Figure 6:
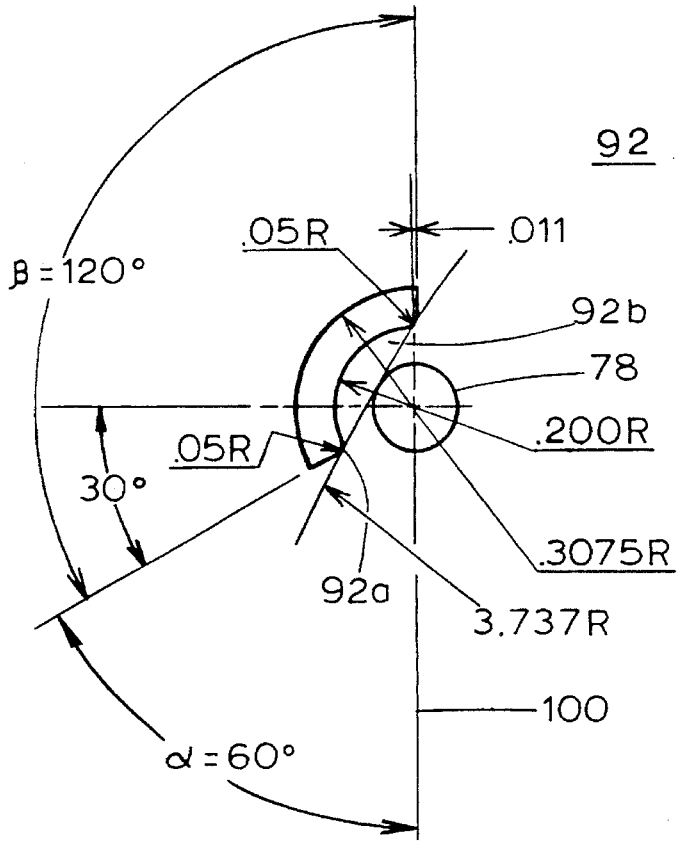
FIGS. 6 and 7 show exemplary dimensions for the detents on the lid cage shown in FIG. 5.

FIG. 6 shows exemplary dimensions for the detent 92. The 3.737 radius of the detent 92 is with respect to the center of the opening 74 of the filter cage 70. The detent 92 has an entrance angle $\alpha$ with respect to a vertical center line 100 of about 60°, and subtends an angle $\beta$ of about 120°.

Figure 7:
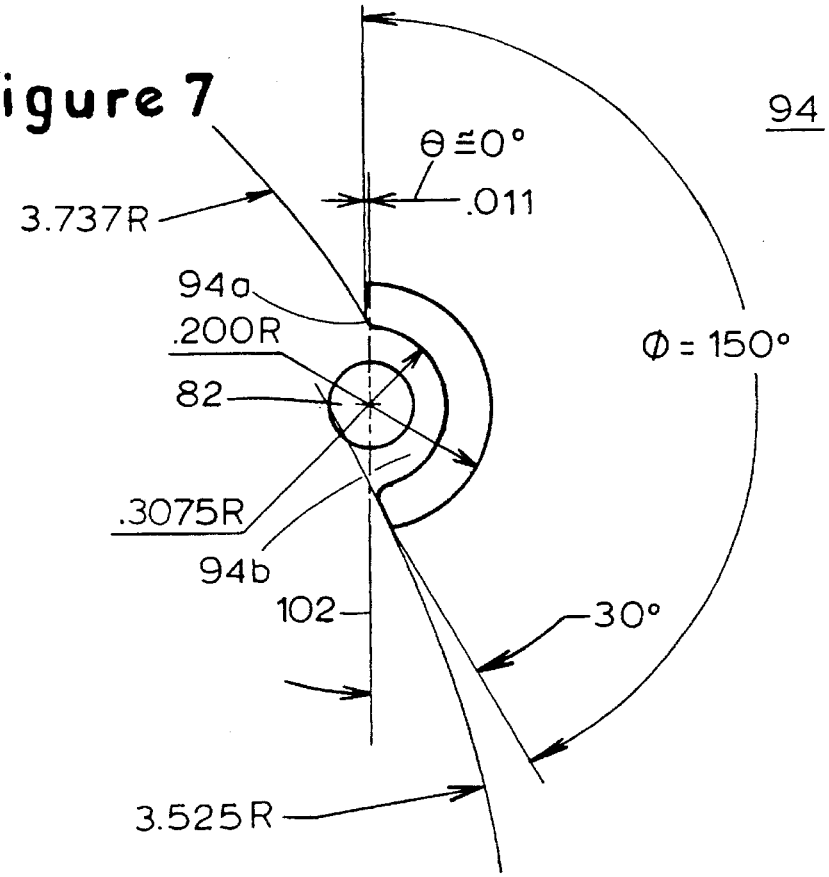

FIG. 7 shows exemplary dimensions for the detent 94. The 3.737 radius of the detent 94 is with respect to the center of the opening 74 of the filter cage 70. The detent 92 has an entrance angle θ with respect to a vertical center line 102 of about 0°, and subtends an angle ϕ of about 150°.

The internally threadable bosses 58*a* and 58*e* may be 3.139 along a line which is perpendicular to a line extending between the internally threadable bosses 58*c* and 60 and through a center 98 of the impeller cover 46*b*. The intersection between the line extending between the internally threadable bosses 58*c* and 60 and a line between the internally threadable bosses 58*a* and 58*e* is 1.813 from the center 98 of the impeller cover 46*b* as viewed in FIG. 9. Accordingly, the internally threadable bosses 58*a* and 58*e* are on a radius of 3.625 from the center 98 of the impeller cover 46*b* as viewed in FIG. 9. The internally threadable bosses 58*a* and 58*e* may have an outer diameter of 0.38, and the radius of the pilot guide wall 62 may be 3.44. The above dimensions may be in inches. With these exemplary dimensions and the exemplary dimensions of the detents 92 and 94 of the lid cage 24, the proper detent action is obtained even if there is some dimensional variation introduced, for example, during molding or modeling.

The foregoing description is for the purpose of teaching those skilled in the art the best mode of carrying out the invention and is to be construed as illustrative only. Many modifications and alterations can be made without departing from the invention. For example, the dimensions given above are by way of example only and may be varied without departing from the scope of the present invention. Also, the motor housing 26 and the cover 28 may be a single molded part instead of separate molded parts. Accordingly, it is intended that all such modifications and alterations be considered within the spirit and scope of the invention as defined in the attached claims.

What is claimed is:

1. A vacuum apparatus comprising:

a holding tank for holding debris picked up by the vacuum apparatus;

a lid cage for holding a filter;

a motor housing for housing a motor as a source of vacuum;

attaching means for attaching the lid cage and the motor housing to the holding tank; and, a detent cooperating with the motor housing and the lid cage for providing an indication to an assembler that the lid cage and the motor have been properly seated with respect to one another.

2. The vacuum apparatus of claim 1 wherein the detent comprises first and second detent projections extending between facing surfaces of the lid cage and the motor housing, wherein the first detent projection has an outer surface, wherein the second detent projection has an inner surface, and wherein the inner surface of the second detent projection is arranged to engage the outer surface of the first surface in a detent action.

3. The vacuum apparatus of claim 2 wherein the first detent projection extends from a surface of the motor housing toward the lid cage, wherein the second detent projection extends from a surface of the lid cage toward the motor housing, and wherein the inner surface of the second detent projection is arranged to engage the outer surface of the first detent projection in a detent action as the lid cage and the motor housing are rotated with respect to one another.

4. The vacuum apparatus of claim 3 wherein the first detent projection has a first hole for receiving a fastener, wherein a second hole is arranged to receive the fastener, wherein the second hole is at least partially encompassed by the second detent projection, and wherein, upon proper seating of the lid cage and the motor housing, the first and second holes are aligned for receiving the fastener.

5. The vacuum apparatus of claim 4 wherein the first detent projection is a stud having the first hole therein, wherein the fastener is a screw having a threaded shaft and a screw head, wherein the first hole is arranged to threadably receive the threaded screw shaft, and wherein the second hole is larger than the threaded screw shaft and smaller than the screw head.

6. The vacuum apparatus of claim 1 further comprising a pilot for guiding relative movement between the lid cage and the motor housing in order to facilitate the indication provided by the detent that the lid cage and the motor have been properly seated.

7. The vacuum apparatus of claim 6 wherein the pilot comprises a pilot projection extending from a surface of the lid cage, wherein the pilot further comprises a guide wall of the motor housing, and wherein the pilot projection and the guide wall are arranged to guide relative rotational movement between the lid cage and the motor housing in order to facilitate the indication provided by the detent that the lid cage and the motor have been properly seated.

8. The vacuum apparatus of claim 7 wherein the motor housing has a surface which faces the surface of the lid cage, wherein the detent comprises first and second detent projections extending between the facing surfaces of the lid cage and the motor housing, wherein the first detent projection has an outer surface, wherein the second detent projection has an inner surface, and wherein the inner surface of the second detent projection is arranged to engage the outer surface of the first surface in a detent action.

9. The vacuum apparatus of claim 8 wherein the first detent projection extends from the surface of the motor housing toward the lid cage, wherein the second detent projection extends from the surface of the lid cage toward the motor housing, and wherein the inner surface of the second detent projection is arranged to engage the outer surface of the first surface in a detent action as the lid cage and the motor housing are rotated with respect to one another under guidance of the pilot projection and the guide wall.

10. The vacuum apparatus of claim 9 wherein the first detent projection is attached to the guide wall.

11. The vacuum apparatus of claim 9 further comprising a motor housed by the motor housing, wherein the pilot projection is curved, wherein the guide wall and the motor form a curved guide slot therebetween, and wherein the curved pilot projection rotates in the arcuate slot as the lid cage and the motor housing are rotated relative to one another during assembly until the detent provides the indication that the lid cage and the motor have been properly seated.

12. The vacuum apparatus of claim 11 wherein the first detent projection has a first hole for receiving a fastener, wherein a second hole is arranged to receive the fastener, wherein the second hole is at least partially encompassed by the second detent projection, and wherein, upon proper seating of the lid cage and the motor housing, the first and second holes are aligned for receiving the fastener.

13. The vacuum apparatus of claim 12 wherein the first detent projection is a stud, wherein the stud has the first hole therein, wherein the stud is attached to the guide wall of the motor housing, wherein the fastener is a screw having a threaded shaft and a screw head, wherein the first hole is arranged to threadably receive the threaded screw shaft, and wherein the second hole is larger than the threaded screw shaft and smaller than the screw head.

14. The vacuum apparatus of claim 7 further comprising a motor housed by the motor housing, wherein the guide wall and the motor form a curved guide slot therebetween, wherein the pilot projection is curved, and wherein the curved pilot projection rotates in the curved guide slot as the lid cage and the motor housing are rotated relative to one another during assembly until the detent provides the indication that the lid cage and the motor have been properly seated.

15. A vacuum apparatus comprising:

a holding tank for holding debris picked up by the vacuum apparatus;

a lid cage for holding a filter, the lid cage having an attaching mechanism for attaching the lid cage to the holding tank;

a motor housing attachable to the lid cage;

a detent cooperating with the motor housing and the lid cage for providing an indication to an assembler that the lid cage and the motor have been properly seated with respect to one another; and, a pilot for guiding relative movement between the lid cage and the motor housing in order to facilitate the indication provided by the detent that the lid cage and the motor have been properly seated.

16. The vacuum apparatus of claim 15 wherein the detent comprises first and second detent projections extending between facing surfaces of the lid cage and the motor housing, wherein the first detent projection has an outer surface, wherein the second detent projection has an inner surface, and wherein the inner surface of the second detent projection is arranged to engage the outer surface of the first surface in a detent action.

17. The vacuum apparatus of claim 16 wherein the first detent projection extends from a surface of the motor housing toward the lid cage, wherein the second detent projection extends from a surface of the lid cage toward the motor housing, and wherein the inner surface of the second detent projection is arranged to engage the outer surface of the first detent projection in a detent action as the lid cage and the motor housing are rotated with respect to one another.

18. The vacuum apparatus of claim 17 wherein the first detent projection has a first hole for receiving a fastener, wherein a second hole is arranged to receive the fastener, wherein the second hole is at least partially encompassed by the second detent projection, and wherein, upon proper seating of the lid cage and the motor housing, the first and second holes are aligned for receiving the fastener.

19. The vacuum apparatus of claim 18 wherein the first detent projection is a stud having the first hole therein, wherein the fastener is a screw having a threaded shaft and a screw head, wherein the first hole is arranged to threadably receive the threaded screw shaft, and wherein the second hole is larger than the threaded screw shaft and smaller than the screw head.

20. The vacuum apparatus of claim 15 wherein the pilot comprises a pilot projection extending from a surface of the lid cage, wherein the pilot further comprises a guide wall extending from a surface of the motor housing, and wherein the pilot projection and the guide wall are arranged to guide relative rotational movement between the lid cage and the motor housing in order to facilitate the indication provided by the detent that the lid cage and the motor have been properly seated.

21. The vacuum apparatus of claim 20 further comprising a motor housed by the motor housing, wherein the guide wall and the motor form a curved guide slot therebetween, wherein the pilot projection is curved, and wherein the curved pilot projection rotates in the curved guide slot as the lid cage and the motor housing are rotated relative to one another during assembly until the detent provides the indication that the lid cage and the motor have been properly seated.

22. The vacuum apparatus of claim 21 wherein the surfaces of the lid cage and the motor housing are facing surfaces, wherein the detent comprises first and second detent projections extending between the facing surfaces of the lid cage and the motor housing, wherein the first detent projection has an outer surface, wherein the second detent projection has an inner surface, and wherein the inner surface of the second detent projection is arranged to engage the outer surface of the first surface in a detent action.

23. The vacuum apparatus of claim 22 wherein the first detent projection extends from the surface of the motor housing toward the lid cage, wherein the second detent projection extends from the surface of the lid cage toward the motor housing, and wherein the inner surface of the second detent projection is arranged to engage the outer surface of the first surface in a detent action as the lid cage and the motor housing are rotated with respect to one another under guidance of the curved pilot projection and guide wall.

24. The vacuum apparatus of claim 23 wherein the first detent projection is attached to the guide wall extending from the surface of the motor housing.

25. The vacuum apparatus of claim 23 wherein the first detent projection has a first hole for receiving a fastener, wherein a second hole is arranged to receive the fastener, wherein the second hole is at least partially encompassed by the second detent projection, and wherein, upon proper seating of the lid cage and the motor housing, the first and second holes are aligned for receiving the fastener.

26. The vacuum apparatus of claim 25 wherein the first detent projection is a stud, wherein the stud has the first hole therein, wherein the stud is attached to the guide wall extending from the surface of the motor housing, wherein the fastener is a screw having a threaded shaft and a screw head, wherein the first hole is arranged to threadably receive the threaded screw shaft, and wherein the second hole is larger than the threaded screw shaft and smaller than the screw head.

27. A subassembly for a vacuum apparatus comprising:

a lid cage for holding a filter;

a motor housing attachable to the lid cage; and, a detent cooperating with the motor housing and the lid cage for providing an indication to an assembler that the lid cage and the motor housing have been properly seated with respect to one another.

28. The subassembly of claim 27 further comprising a pilot for guiding relative movement between the lid cage and the motor housing in order to facilitate the indication provided by the detent that the lid cage and the motor have been properly seated.

29. The vacuum apparatus of claim 28 wherein the pilot comprises a pilot projection and a guide slot, and wherein the pilot projection and the guide wall are arranged to guide relative rotational movement between the lid cage and the motor housing in order to facilitate the indication provided by the detent that the lid cage and the motor have been properly seated.

30. The vacuum apparatus of claim 29 further comprising a motor housed by the motor housing, wherein the guide slot is formed between the motor and a guide wall of the motor housing, and wherein the pilot projection rotates in the guide slot as the lid cage and the motor housing are rotated relative to one another during assembly until the detent provides the indication that the lid cage and the motor have been properly seated.

* * * * *